US005268705A

United States Patent [19]

Dreinhoff et al.

[11] Patent Number: 5,268,705

[45] Date of Patent: Dec. 7, 1993

[54] IMAGE PRINTING DEVICE

[75] Inventors: Karl-Heinz Dreinhoff, Berlin; Thomas Schmidt, Kochendorf, both of Fed. Rep. of Germany

[73] Assignee: Mannesmann Aktiengesellschaft, Düsseldorf, Fed. Rep. of Germany

[21] Appl. No.: 784,159

[22] Filed: Oct. 28, 1991

Related U.S. Application Data

[63] Continuation-in-part of PCT/DE90/00312, Apr. 4, 1990.

[30] Foreign Application Priority Data

Apr. 28, 1989 [DE] Fed. Rep. of Germany ..... 730113
Dec. 22, 1989 [DE] Fed. Rep. of Germany ..... 3943238

[51] Int. Cl.[5] ..... B41J 2/32
[52] U.S. Cl. ..... 346/76 PH; 346/134
[58] Field of Search ..... 346/76 PH; 400/120; 346/134

[56] References Cited

U.S. PATENT DOCUMENTS 4,552,470 11/1985 Yana et al. ..... 346/76 PH
4,586,834 5/1986 Hachisuga et al. ..... 346/76 PH

*Primary Examiner*—Benjamin R. Fuller
*Assistant Examiner*—Huan Tran
*Attorney, Agent, or Firm*—Horst M. Kasper

[57] ABSTRACT

A recording head of an image printing device is disposed opposite to a pressure roller in a casing. The casing upper side includes a sheet feed aperture for a feed of individual sheets to be printed and a sheet ejection aperture for ejection of the printed individual sheets. The casing upper side exhibits a flap-open cover (29). The flap-open cover can be fixed in an inclined position in the flapped-open state and under formation of a sheet storage cassette (30) for a stack (31) of individual sheets to be printed in order to allow a selective manual or automatic feed of individual sheets while maintaining a compact construction of the known image printing device. A drivable sheet draw-in roller (18) is supported in a casing (1) and is pivotally mounted between two positions at a lever portion (16). In these positions, the drivable sheet draw-in roller (18) is either disposed in the casing interior or rests on the individual sheets, disposed in the sheet storage cassette (30).

28 Claims, 5 Drawing Sheets

IMAGE PRINTING DEVICE

CROSS-REFERENCE TO RELATED APPLICATIONS

This application is a continuation-in-part application of another international application filed under the Patent Cooperation Treaty Apr. 26, 1990, bearing Application No. PCT/DE90/00312, and listing the United States as a designated and/or elected country. The entire disclosure of this latter application, including the drawings thereof, is hereby incorporated in this application as if fully set forth herein.

BACKGROUND OF THE INVENTION

1. Field of the Invention

The present invention relates to an image printing device with a recording head, where the recording head is disposed in a casing of the device opposite to a pressure roller, with a sheet feed aperture contained in the upper side of the casing, where a sheet draw-in channel leads from the sheet feed aperture to the pressure roller, and with a sheet ejection channel, which leads from the pressure roller up to a sheet ejection aperture contained in the upper side of the casing.

2. Brief Description of the Background of the Invention Including Prior Art

Such an image printing device is known from the German Printed Patent document DE-A-3,539,526 and is formed as a parallel operating thermal transfer printer. A line-shaped recording head is disposed within a casing of the thermal transfer printer. A pressure roller is disposed opposite to the recording head in an axially parallel alignment. An ink ribbon cassette can be inserted into the casing. An ink ribbon is stored in the ink ribbon cassette on two winding bobbins, disposed axially parallel to the pressure roller. The ink ribbon section of the ink ribbon, disposed in each case between the two winding bobbins, runs between the recording head and the pressure roller. The ink ribbon cassette includes in the area of the upper side of the casing a window-shaped opening, serving simultaneously as a sheet feed aperture and as a sheet ejection aperture. An individual sheet to be printed can be inserted through the window-shaped opening into a sheet draw-in slot formed by the ink ribbon and the pressure roller. The individual sheet is guided by the rotating pressure roller past the recording head, accompanied by intermediate dispositioning of the ink ribbon. The individual sheet is printed on by the recording head and, subsequently, the individual sheet is lead through the window-shaped opening out of the known image printing device.

Only a manual feed of individual sheets to be printed is possible in connection with the known image printing device. However, an automatic separation and feed of individual sheets of a sheet storage is not provided.

An image printing device is known from the European Printed Patent document EP-A-0,106,801. This image printing device can be provided with an attachment, which can be put on top of the casing of the device, for an automatic feeding of individual sheets from a sheet storage. The top attachment exhibits an inclined disposed sheet storage cassette with a sheet separating device and a sheet deposit for receiving the individual sheets after they have been printed. The construction height level of the known apparatus is determined substantially by the top attachment. Moreover, the top attachment has to be handled separately as an addition to the device.

Finally, an image printing device is known from the German Printed Patent document DE-A-3,504,029. A sheet storage cassette can be inserted horizontally like a drawer into the casing of the device. Since the sheet storage cassette requires an apparatus base area corresponding at least to the size of the individual sheets to be printed, this known device also exhibits a relatively large construction volume.

Up to now, automatic individual sheet feed devices have not become known for the above reasons, in particular in connection with so-called laptop apparatus, which are characterized by a particularly compact construction and which can be transported like a briefcase or which can be transported in such a briefcase.

SUMMARY OF THE INVENTION

1. Purposes of the Invention

It is an object of the present invention to furnish an image printing device, where a manual or automatic individual sheet feed is selectively possible and where the invention device is nevertheless characterized by a particularly compact construction.

It is another object of the present invention to provide a printer where the discharge bin is in a firm position.

It is a further object of the present invention to provide a portable printer exhibiting a reliable draw-in sheet feed.

These and other objects and advantages of the present invention will become evident from the description which follows.

2. Brief Description of the Invention

The present invention provides an image printing device comprising a casing having an upper side, where a pressure roller is disposed in the casing. A recording head is disposed in the casing opposite to the pressure roller. A sheet feed aperture is contained in the upper side of the casing. A sheet feed channel leads from the sheet feed aperture to the pressure roller. A sheet ejection aperture is contained in the upper side of the casing. A sheet ejection channel leads from the pressure roller to the sheet ejection aperture. A cover is disposed on the upper side of the casing. The cover is flappable for opening the cover. Means are included for fixing the cover in an inclined position in the flapped-open state under formation of a sheet storage cassette for a stack of individual sheets to be printed. A drivable sheet draw-in roller is disposed in the casing and is tiltably supported at a lever part such that the sheet draw-in roller is disposed below the cover while the cover is closed. The sheet draw-in roller rests on the individual sheets, contained in the sheet storage cassette in case of an open cover.

The sheet draw-in roller can rest in the course of the sheet draw-in channel at the counter roller while the cover is closed.

A rotation axis can run below the upper side of the casing. The cover can be furnished with a cover edge disposed toward the sheet draw-in roller and parallel to the sheet draw-in roller. The cover can be tiltably supported in the region of the cover edge via a spacer part around the rotation axis.

Casing-fixed guides can be included and can exhibit a partial circular shape. The center points of the partial circles can be disposed on a straight line running parallel to the pressure roller and running below the upper side of the casing. Extensions attached to the cover in the region of an end of the cover can be disposed near the sheet draw-in roller. Said extensions can be led in the casing-fixed guides.

Preferably, a sheet stop edge with sheet separating corners is disposed in the casing and serves as a stop for the individual sheets, stored in the sheet storage cassette, where the cover is disposed with a cover edge opposite to the sheet stop edge in the flapped-open state of the cover. A follower device can be disposed at the lever part and can support the sheet draw-in roller. Spring support means can springingly hold the sheet separating corners at the sheet stop edge. The sheet separating corners can be lifted by the follower device together with the sheet draw-in roller from the stack of individual sheets in the sheet storage cassette.

Sheet separating corners can be disposed in the region of the ends of the cover edge for separating individual sheets stored in the sheet storage cassette. The cover can include at least one sheet stop in the region of the cover edge disposed facing the sheet draw-in roller and disposed parallel to the sheet draw-in roller. The cover can be formed of a first cover part and of a second cover part. The first cover part can be connected at a parallel edge, disposed opposite the cover edge facing the sheet draw-in roller, via a hinge to the second cover part.

A pivotally mounted sheet deposit bin can receive printed individual sheets, coming from the sheet ejection channel, supported at the lever part carrying the sheet draw-in roller, where the sheet deposit bin can be flapped from a sunken position below said cover in the casing of the device while the cover is closed, into an approximately parallel inclined position while the cover is flapped open. The sheet draw-in roller, upon resting on the individual sheets contained in the sheet storage cassette, can rest together with the sheet transport advance roller, resting at the sheet draw-in roller, in the course of the sheet ejection channel. The sheet deposit bin can be disposed immediately behind the sheet draw-in roller as seen in sheet transport advance direction of the sheet draw-in roller. A drivable sheet transport advance roller can be disposed concentrically to a rotation axis of the lever part and can rest between the pressure roller and the sheet draw-in roller while the sheet draw-in roller is resting on the individual sheets contained in the sheet storage cassette. The sheet deposit bin can be disposed immediately behind the sheet transport advance roller as seen in sheet transport advance direction.

A support frame can be pivotally held in the casing and can protrude upwardly out of the casing. A recording head with an electrical control device can be disposed in a floor region of the casing. At least the pressure roller and the lever part can be held with the sheet draw-in roller at a support frame. The support frame can assume two support positions in front of and behind the pressure roller as seen in sheet transport advance direction of the pressure roller for insertion of winding bobbins disposed axially parallel to the pressure roller. A gear wheel can engage a belt drive and can be disposed at the support frame immediately next to the support position behind the pressure roller for driving the winding bobbins, inserted at said support position.

Receiving and alignment elements can be disposed in a floor region of the casing for a detachable attachment of a support body for a pressure-roller-parallel receiving of winding bobbins disposed parallel to the pressure roller.

A flappable cover is furnished in the casing upper side of the device of the initially recited kind. The cover can be fixed in an inclined position in the flapped-open state under formation of a sheet storage cassette for the individual sheets to be printed. A drivable sheet draw-in roller can be pivotally supported at a lever part in the casing such that the sheet draw-in roller is disposed below the cover in case of a closed cover, and rests on the individual sheets contained in the sheet storage container, in case of a flapped-open cover.

A substantial advantage of the image printing device according to the present invention comprises that the image printing device exhibits, in case of a closed cover, an extremely compact structure with lowest possible outer dimensions suitable for transporting purposes. The sheet storage cassette, required for an automatic feed of individual sheets, is formed by a simple flapping open of the cover. It is a further advantage that, in case of a closed cover, the sheet draw-in roller can be sunk completely into the casing, where the sheet feed roller rests, in case of a flapped-open cover, in each case on the uppermost individual sheet of a sheet stack, inserted into a sheet storage cassette formed by the cover, and allows an automatic sheet separation and sheet feed, with respect to the compact construction and easy transport of the invention image printing device. Finally, the cover serves advantageously both as a protection and a covering for sensitive parts of the image printing device during its transport, as well as a protection for the respective transport means, for example a briefcase, relative to sharp-edged parts of the device.

In order to render the manual sheet feed even more user friendly and in order to further improve the operational safety and reliability of the paper transport, an advantageous embodiment of the invention image printing device provides that the sheet draw-in roller rests at a counter roller in the course of the sheet draw-in channel in case of a closed cover.

The sheet draw-in roller performs a dual function according to this embodiment, whereby the number of the function parts, required for the selectively manual or automatic sheet feed, is kept as low as possible. This results in space savings in the interior of the casing. This further contributes to the compact structure of the invention image printing device and results in a correspondingly low weight.

According to a further advantageous embodiment of the invention image printing device, it is provided that the cover is pivotally supported in the region of a cover edge, turned toward the sheet draw-in roller and disposed parallel to the sheet draw-in roller, via a spacer part and around a rotation axis, running below the casing upper side.

It is thereby in particular achieved that the sheet storage cassette, formed by the flapped-open cover, passes only upon flapping open of the cover into the pivoting range of the lever part with the sheet draw-in roller, attached at the lever part, such that the sheet draw-in roller, in case of a closed cover, is sunken unimpededly into the casing or, respectively, can come to rest at the counter roller under formation of the sheet draw-in mechanism for the manual sheet feed.

A particularly advantageous embodiment of the invention image printing device relative to the construction expenditure and to the weight provides that the cover exhibits extensions in the area of on its end, disposed close to the sheet draw-in roller. The extensions are guided in guides, fixedly disposed relative to the case. The guides are formed of an approximately partially circular shape, where the center points of the partial circles are disposed on a straight line, running below the casing upper side and parallel through the pressure rollers. In case of a plastic casing, the guides can be formed by directly molding groove-shaped recesses at the inner sides of the lateral casing walls during the injection molding process. The extensions of the cover can, for example, also be directly injection molded or cast on such that the guiding of the cover is effected without guide elements requiring separate production.

The guides can also be formed as concave polygons relative to the pressure roller, wherein the center points of the enveloping partial circles are then substantially resting on the pressure roller-parallel line, running below the casing upper side.

A further advantageous embodiment of the invention image printing device comprises that a sheet stop edge with sheet separation corners serves a stop for the individual sheets stored in the sheet storage cassette and is disposed in the casing, where the cover in the flapped-open state comes to rest with its cover edge opposite to said sheet stop edge. Further function elements are thereby fixedly disposed in the casing interior, which has an advantageous effect in particular in connection with the transport of the image printing device.

In order to alleviate the insertion of the sheet stack of individual sheets into the sheet storage cassette and in order to allow a refilling of individual sheets onto the sheet stack, advantageously the sheet separating corners are spring-supportedly held at the sheet stop edge. The sheet separating corners together with the sheet draw-in roller can be lifted from the individual sheets in the sheet storage cassette by a follower device at the lever part supporting the sheet draw-in roller.

An embodiment, advantageous with respect to a production technological view and with respect to the assembly of the image printing device of the invention, provides that the cover exhibits at least one sheet stop in the area of a cover edge, disposed toward the sheet draw-in roller and disposed parallel to the sheet draw-in roller, and that the cover exhibits sheet separating corners for the individual sheets, stored in the sheet storage cassette, in the area of the ends of the cover edge.

Since the cover serves as a sheet storage cassette in the invention image printing device, it is required that the cover exhibits in the flapped-open state the size of the individual sheets to be received. It is provided according to an advantageous embodiment of the invention device that the cover is formed of two cover parts, of which one cover part is connected at a parallel edge, disposed opposite to the cover side facing the sheet draw-in roller, via a hinge to the other cover part in order to maintain the casing dimensions of the invention image printing device particularly low, independent of the size of the cover. Upon closing of the cover, the two cover parts are folded together such that the size of the closed cover and thus the required projection plane of the invention image printing device is smaller than the size of the sheet storage cassette formed by the flapped-open cover.

In order to allow a defined deposit for the individual sheets following printing in connection with the automatic individual sheet feed from the sheet storage cassette, a pivotally-disposed sheet deposit bin for receiving the printed individual sheets coming from the sheet ejection channel is advantageously held at the lever part, supporting the sheet draw-in roller. Said sheet deposit bin can be flapped open from a position, sunken below the cover in the casing of the device in case of a closed cover, into a position approximating the parallel inclined position of the cover, in case of a flapped-open cover. Therefore, the sheet deposit can be sunk under the cover in the casing of the device for the transport of the invention image printing device such that the device overall exhibits a very compact construction.

In order to achieve a reduction of the function parts, required for the transport of the individual sheets within the invention image printing device, there is provided, according to an advantageous further embodiment of the invention device, that the sheet draw-in roller, in case the draw-in roller rests on the individual sheets contained in the sheet storage cassette, together with a sheet transport advance roller, resting at the sheet draw-in roller, is disposed in the course of the sheet ejection channel. The sheet deposit bin is disposed in the sheet transport advance direction of the sheet draw-in roller immediately behind this sheet draw-in roller. The multiple use of the sheet draw-in roller is thereby expanded by a further function in that the transport advance of the printed individual sheets into the sheet deposit bin is performed by the sheet draw-in roller.

A particularly advantageous further embodiment of the invention image printing device comprises that, in case of a resting of the sheet draw-in roller on the individual sheets contained in the sheet storage cassette, there is disposed a drivable sheet transport advance roller, disposed concentrically to the rotation axis of the lever part, between the pressure roller and the sheet draw-in roller, and that the sheet deposit bin is disposed immediately behind the sheet transport advance roller as seen in the sheet transport advance direction. This is associated with the advantage that the rotation axis of the lever part can be used according to a further function for the support of the sheet transport advance roller. The sheet transport advance roller can be driven with an independent circumferential speed, where the circumferential speed is selected slightly higher as compared to the circumferential speed of the sheet draw-in roller such that a tight and correct guiding of the printed individual sheets is always assured in the region of the sheet ejection channel.

According to a further advantageous embodiment of the invention image printing device, it is provided that the recording head with an electrical control device is disposed in the floor region of the casing of the device and that at least the pressure roller and the lever part are supported with the sheet draw-in roller at a support frame, where the support frame is supported in the casing and can be pivoted upwardly out of the casing. It is thereby achieved that the transport advance distance path for the individual sheets can be freed by a simple upward tilting of the support frame in order to remove any possibly jammed individual sheets. In addition, the recording head and the electrical control device are thereby freed and laid open for maintenance and repair purposes.

The support frame exhibits advantageously, as seen in sheet transport advance direction of the pressure roller in front and behind said pressure roller, two support positions for the insertion of winding bobbins, disposed axially parallel to the the pressure roller. A gear wheel is disposed at the support frame immediately next to the support position, disposed behind the pressure roller, and engages a drive for driving the winding bobbin, employed at this support position. Advantageously there results herefrom a plurality of further possible modes of operation for the invention image printing device. For example, instead of manually or automatically advanced individual sheets, there ca be employed a winding bobbin with continuous roll paper to be printed at the support position in front of the pressure roller, where the printed continuous roll paper can, as desired, either be ejected through the sheet ejection channel from the image printing device or, if for example the printed information is not to be accessible to every person, the printed continuous roll paper can be wound onto a further winding bobbin in the interior of the casing at the support position behind the pressure roller. In this latter case, there exists further the possibility to feed endless paper to be printed from the outside through the sheet feed aperture and the thereto following sheet draw-in channel up to the pressure roller and, following the printing, to wind the endless paper onto a winding bobbin, disposed behind the pressure roller.

A further advantageous embodiment of the invention image printing device comprises that receiving and alignment elements for a detachable attachment of a support body for the pressure-roller-parallel reception of winding bobbins are furnished in the floor region of the casing. The two winding bobbins can be inserted with the support body in the casing of the device and can be taken out of this casing of the device again in a particularly user-friendly way.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention.

DESCRIPTION OF INVENTION AND PREFERRED EMBODIMENT

Figure 1:
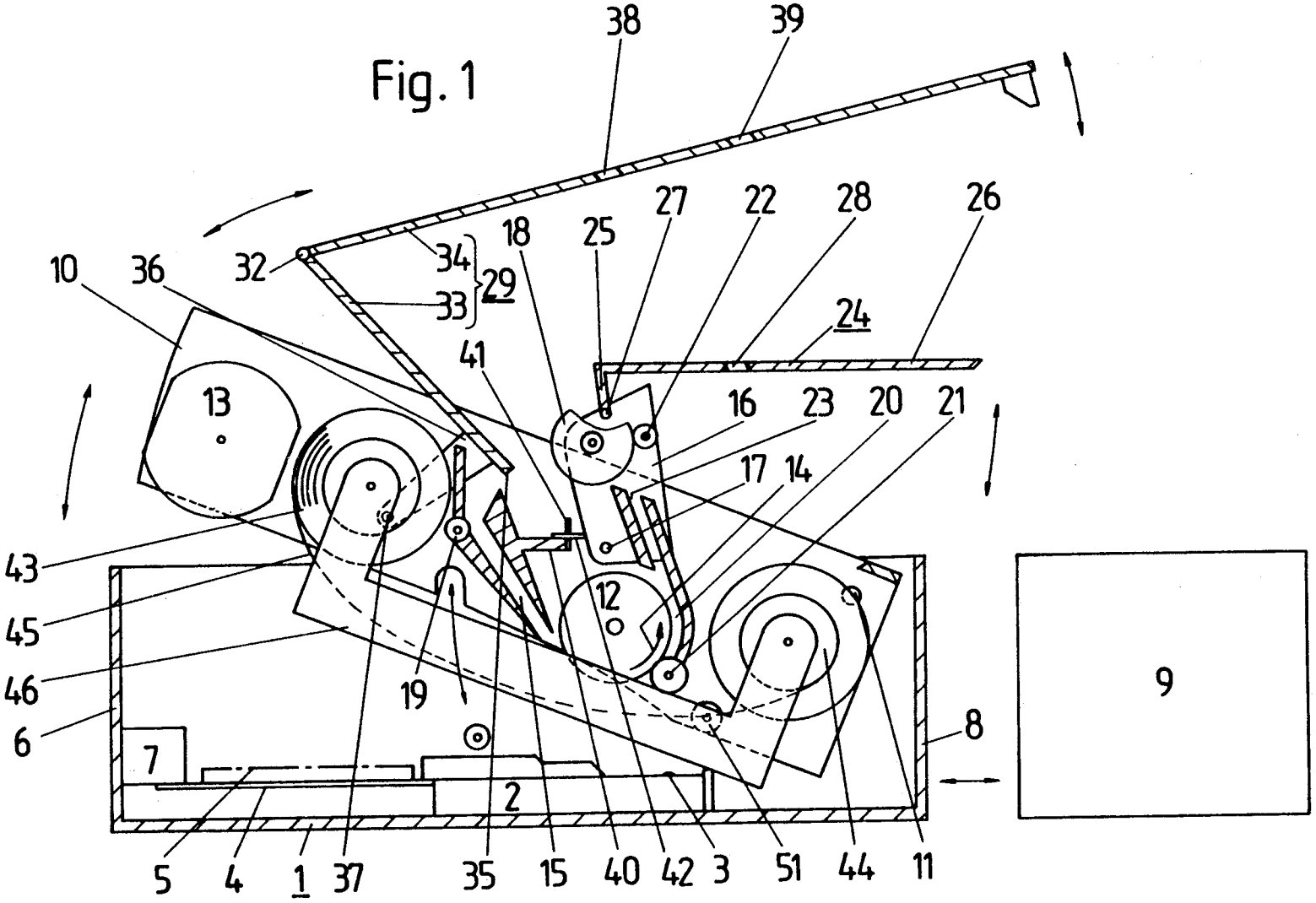
FIG. 1 a longitudinal sectional view through a preferred embodiment of the invention device, where the pivotable function parts, essential for the invention, are in part flapped open.

According to the present invention, there is provided for an image printing device with a recording head 2, which is disposed in a casing 1 of the device opposite to a pressure roller 12. A sheet feed aperture 38 is contained in an upper side of the casing. A sheet feed channel 15 leads from the sheet feed aperture 38 to the pressure roller 12. A sheet ejection channel 20 leads from the pressure roller 12 to a sheet ejection aperture 39, contained in the upper side of the casing. The upper side of the casing exhibits a cover 29 which can be flapped open, and which can be fixed in an inclined position in the flapped-open state under formation of a sheet storage cassette 30 for a stack 31 of individual sheets to be printed. A drivable sheet draw-in roller 18 in the casing 1 is tiltably supported at a lever part 16 such that the sheet draw-in roller 18 is disposed below the cover 29 in case of a closed cover 29 (FIG. 3) and rests on the individual sheets, contained in the sheet storage cassette 30 in case of an open cover 29 (FIG. 4).

The sheet draw-in roller 18 can rest in case of a closed cover 29 (FIG. 3) in the course of the sheet draw-in channel 15 at a counter roller 19.

The cover 29 can be tiltably supported in the region of a cover edge 35, disposed toward the sheet draw in roller 18 and parallel to the sheet draw-in roller 18, via a spacer part 36 around a rotation axis 37, running below the upper side of the casing.

The cover 29 can exhibit extensions, for example 77, in the region of its end near the sheet draw-in roller 18. Said extensions can be led in casing-fixed guides, for example 75. The guides, for example 75, can be of a partial circular shape. The center points of the partial circles can be disposed on a straight line running parallel to the pressure rollers and running below the upper side of the casing.

A sheet stop edge 40 with sheet separating corners 41 and serving as a stop for the individual sheets 31, stored in the sheet storage cassette 30, can be disposed in the casing 1. The cover 29 in the flapped-open state (FIG. 4) can be disposed with its cover edge 35 opposite to the sheet stop edge 40.

The sheet separating corners 41 can be springingly held at the sheet stop edge 40 and can be lifted by a follower device 42 at the lever part 16, supporting the sheet draw-in roller 18, together with the sheet draw-in roller 18 from the stack 31 of individual sheets in the sheet storage cassette 30.

The cover 29 can exhibit at least one sheet stop in the region of a cover edge 35, disposed facing the sheet draw-in roller 18 and parallel to the sheet draw-in roller 18, and with sheet separating corners for the individual sheets stored in the sheet storage cassette 30 in the region of the ends of the cover edge 38.

The cover 29 can be formed of two cover parts 33, 34. One cover part 33 can be connected at a parallel edge, disposed opposite the cover edge 35 facing the sheet draw-in roller 18, via a hinge 32 to the other cover part 34.

A pivotally mounted sheet deposit bin 24 for receiving of printed individual sheets, coming from the sheet ejection channel 20, can be supported at the lever part 16 carrying the sheet draw-in roller 18. The sheet deposit bin 24 can be flipped from a sunken position (FIG. 3) in case of a closed cover 29 below said cover in the casing 1 of the device, into an approximately parallel inclined position (FIG. 4) in case of a flapped-open cover 29.

The sheet draw-in roller 18, upon resting on the individual sheets 31, contained in the sheet storage cassette 30, can rest together with a sheet transport advance roller 22, resting at the sheet draw-in roller 18, in the course of the sheet ejection channel 20. The sheet deposit bin 24 can be disposed immediately behind the sheet draw-in roller 18 as seen in sheet transport advance direction of the sheet draw-in roller 18.

A drivable sheet transport advance roller 60, disposed concentrically to the rotation axis 17 of the lever part 16, can rest between the pressure roller 12 and the sheet draw-in roller 18 in case of a resting of the sheet draw-in roller 18 on the individual sheets 31, contained in the sheet storage cassette 30. The sheet deposit bin 24 can be disposed immediately behind the sheet transport advance roller 60 as seen in sheet transport advance direction.

The recording head 2 with an electrical control device 5 can be disposed in the floor region of the casing 1 of the device. At least the pressure roller 12 and the lever part 16 can be held with the sheet draw-in roller 18 at a support frame 10. The support frame 10 can be pivotally held in the casing 1 and can protrude upwardly out of the casing 1.

The support frame 10 can exhibit two support positions, for example 47, in front of and behind the pressure roller 12, as seen in sheet transport advance direction 14 of the pressure roller 12, for insertion of winding bobbins 43, 44, disposed axially parallel to the pressure roller 12. A gear wheel 53 can engage the belt drive 48 and can be disposed at the support frame 10 immediately next to the support position behind the pressure roller 12 for driving the winding bobbin 44, inserted at said support position.

Receiving and alignment elements can be provided in the floor region of the casing for a detachable attachment of a support body 46 for a pressure-roller-parallel receiving of winding bobbins 43, 44.

FIGS. 1 through 4 show in each case a thermal printer as a preferred embodiment of the invention image printing device in a longitudinal sectional view. The illustrated image printing device comprises a casing 1. A thermal print head is disposed as recording head 2 in the interior of the casing 1 and there immediately in the floor region of the casing 1. The thermal print head includes a line running perpendicular to the printing character plane of individually controllable heating elements 3. The recording head 2 is connected on its connection side to a printed circuit board 4. The printed circuit board 4 carries an electrical control device 5 for the image printing device, indicated in the drawing only through a dash-dotted peripheral line. The printed circuit board 4 is further connected at its edge, disposed remote relative to the recording head 2, to a connection bushing 7, inserted in a casing wall 6 and accessible from the outside, for a feeding of image recording data and control signals to the electrical control device 5. The casing 1 is disengageably connected at the oppositely disposed casing wall 8 with a power supply part 9, indicated in the drawing only with a dash-dotted peripheral line. The casing 1 and the power supply part 9 together form the complete image printing device upon structural and functional engagement.

A support frame 10 for a plurality of function parts of the image printing device, to be further illustrated in the following, is held pivotally around a pivot axis 11, running near the casing wall, which casing wall is designated with the reference numeral 8, and perpendicular to the drawing plane, in the interior of the casing 1, such that the support frame 10 together with the function parts, held at the support frame 10, can be pivoted upwardly from the interior of the casing 1 by more than 90° into a position illustrated in FIG. 2, which makes the function parts at the support frame accessible from the outside and which lays open the recording head 2 and the printed circuit board 4 with the electrical control device 5. The following function parts, essential for the illustration of the invention, are disposed at the support frame 10, wherein reference is made in particular to FIG. 1.

A pressure roller 12 is supported at the support frame 10 parallel to the line with the heating elements 3. The pressure roller 12 comes to rest immediately opposite to the line with the heating elements 3 in the interior of the casing 1 upon flapping in of the support frame 10, as is illustrated additionally in FIGS. 3 and 4. The pressure roller 12 serves to transport a recording substrate to be printed, for example in the form of individual sheets, past the heating elements 3, as will be further explained below, while the recording substrate is printed by the heating elements 3. For this purpose, the pressure roller 12 is driven by a motor 13, also attached to the support frame 10, via a belt drive, to be illustrated in more detail below by way of FIG. 2, in a sheet transport advance direction (rotation direction) designated with reference numeral 14. A sheet draw-in channel 15, formed by sheet guide elements, for the recording substrate to be printed is disposed at the support frame 10 as seen in sheet transport feed direction in front of the contact position of the pressure roller 12 and the recording head 2. A drivable sheet draw-in roller 18 is tiltable against a fixedly disposed counter roller 19 in the course of the sheet draw-in channel 15, where the drivable sheet draw-in roller 18 is tiltably supported at a lever part 16 around a rotation axis 17, such that the two rollers 18 and 19 form a draw-in insertion feed for the recording substrate to be printed (compare also FIG. 3). A sheet ejection channel 20, formed also by sheet guide elements, follows behind the contact position of the pressure roller 12 with the recording head 2, as seen in sheet transport advance direction 14 of the pressure roller 12. A sheet press-on roller 21 rests at the pressure roller 12 in the initial course of the sheet ejection channel 20.

Furthermore, a sheet transport advance roller 22 is supported next to the sheet draw-in roller 18 at the lever part 16 such that, upon tilting of the sheet draw-in roller 18 away from the counter roller 19, the sheet draw-in roller 18 reaches together with the sheet transport advance roller 22 an output opening of the sheet ejection channel 20 such that the printed recording substrate, coming from the sheet ejection channel 20, passes between the two rollers 18 and 22, and the printed recording substrate can be further transported by the two rollers 18 and 22 (compare also FIG. 4).

A sheet deposit bin 24 with a short sheet support face 25 and a longer sheet stop face 26, running about perpendicular to the short sheet support face 25, is tiltably supported around an axis 27 at the lever part 16 for receiving printed individual sheets, coming from the sheet ejection channel 20. The sheet deposit bin 24 can be flapped into the interior of the casing 1 if the support frame 10 is tilted into the interior of the casing 1 and the sheet draw-in roller 18 rests at the counter roller 19 (compare FIG. 3). A slot 28, contained in the sheet deposit bin 24, comes to rest in front of the exit opening 23 of the sheet ejection channel 20 and makes possible a passage for the printed recording substrate.

Furthermore, a cover 29 is supported at the support frame 10. As desired, the cover 29 forms in a closed state (compare FIG. 3) the upper side of the casing 1, or the cover 29 forms the sheet storage cassette 30 for receiving a stack 31 of individual sheets to be printed in a flapped-open state (compare FIG. 4). For this purpose, the cover 29 comprises two cover parts 33 and 34, connected to each other via a hinge 32. The cover part, designated with reference numeral 33, is tiltably supported at the support frame 10 in the region of the cover edge 35 of the cover part 33, disposed remote to the hinge and disposed toward the sheet draw-in roller 18 via a spacer part 36 around a rotation axis 37, running perpendicular to the drawing plane and below the casing upper side. The second cover part 34 exhibits about the same length as the casing 1 of the device, wherein, as illustrated in FIG. 4, this cover part 34 closes the casing 1 of the device upwardly in case of a support frame 10 swivelled into the interior of the casing 1 and in case of a closed cover 29, such that the image printing device then forms a rectangular parallelepiped representing a compact and thus easily transportable apparatus. A sheet feed aperture 38 as well as a sheet ejection aperture 39 is in each case contained in the shape of a slot in the cover part, designated with reference numeral 34. The sheet feed aperture 38 is aligned with the sheet draw-in channel 15, in case of a flapped-down cover 29, and the sheet ejection aperture 39 together with the slot 28 is disposed opposite to the exit opening 23 of the sheet ejection channel 20 in the sheet deposit bin 24 (compare FIG. 3). The longitudinal edges of the sheet ejection apertures 39 are furthermore formed as cutting edges and can therefore serve as a rip-off edge for the printed recording substrate.

The sheet storage cassette 30 is formed by the flapping apart of the cover parts 33 and 34 to one single planar sheet support face and by lockingly engaging the cover, designated with the reference numeral 33, in the interior of the casing 1 in an inclined position. The sheet draw-in roller 18 is lifted either manually or, in case of a pivoting of the cover part 33, automatically via a connecting link, not illustrated here, from the the counter roller 19. The cover part 33 with its cover edge 35, disposed toward the sheet draw-in roller 18, is swivelled past under the sheet draw-in roller 18 against a sheet stop edge 40, disposed in this cover position about perpendicular to the cover 29. Sheet separating corners 41 are springingly supported at the sheet stop edge 40 and the sheet stop edge serves as stop for the stack 31 of individual sheets to be printed and inserted into the sheet storage cassette 30. The sheet separating corners 41 can be lifted by a follower device 42, connected to the lever part 16 upon a swivelling of the lever part 16 against the spring pressure jointly with the sheet draw-in roller 18 from the stack 31 of individual sheets, inserted in the sheet storage cassette 30.

Figure 2:
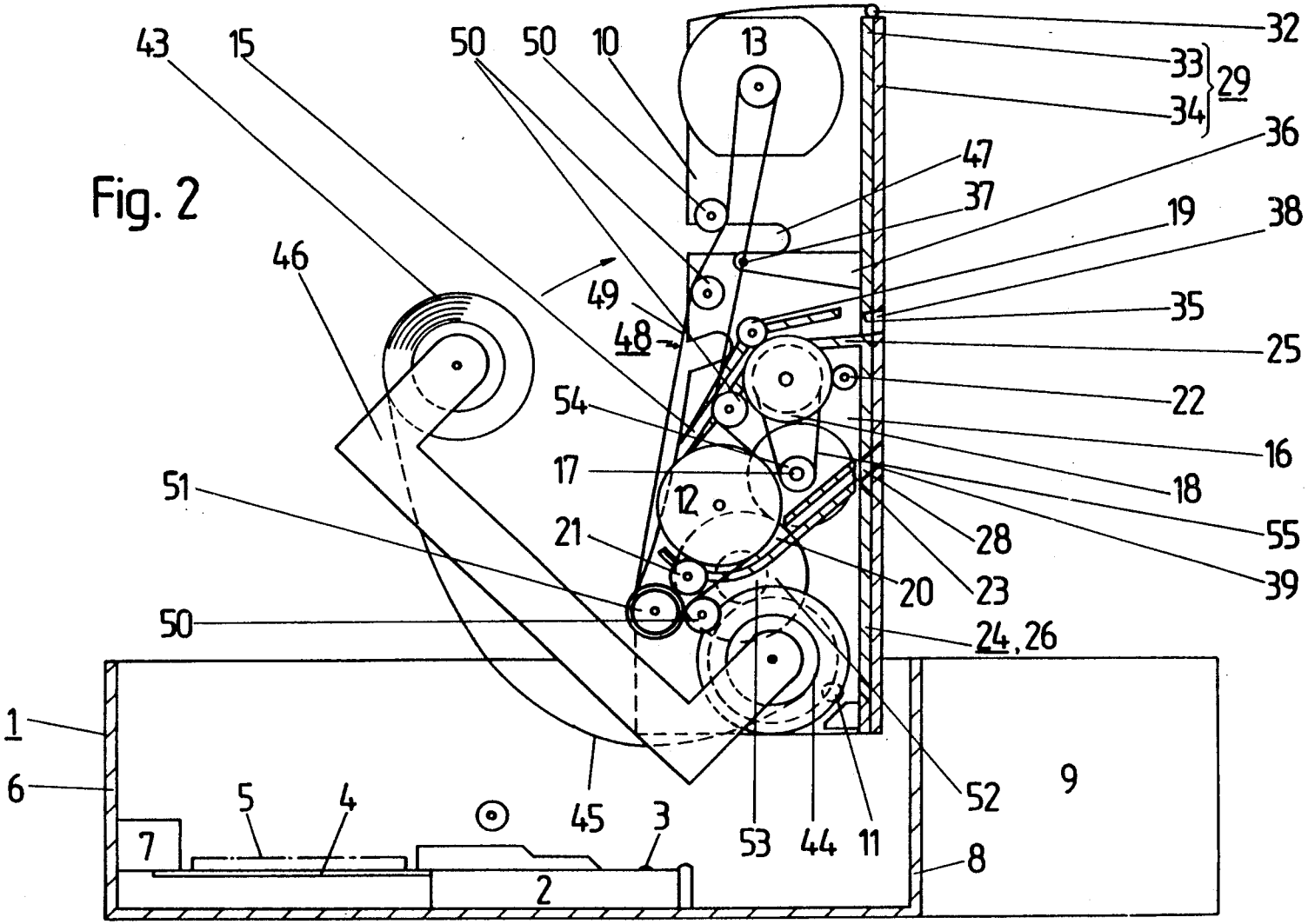
FIG. 2 a longitudinal sectional view through the the embodiment of FIG. 1 with a casing in a position open for an ink ribbon change, and with function elements, required for the paper transport advance and for the ink ribbon transport advance.

Furthermore, two winding bobbins 43 and 44 are supported at the support frame 10 in front of and behind the pressure roller 12, as seen in sheet transport advance direction 14 of the pressure roller 12, as illustrated in FIG. 1. The two winding bobbins 43 and 44 store a heat-sensitive ink ribbon 45 and are disposed axially parallel to each other on a joint support body 46. The support frame 10 exhibits corresponding support positions for inserting the winding bobbins 43 and 44 in the support frame 10. Only the support position 47, disposed in front of the pressure roller 12, as seen in sheet transport advance direction 14, for the winding bobbin 43 can be seen in FIG. 2, while the support position, disposed behind the pressure roller 12, is covered up by the winding bobbin 44 already inserted there.

The support bodies 46 could also be inserted in receiving and alignment elements, not illustrated in FIGS. 1 to 4 in detail, where the receiving and alignment elements are fixedly disposed relative to the casing in the floor region of the casing for insertion of the ink ribbon 45. The support frame is then brought into an upright position according to FIG. 2 and the support body with the winding bobbins, carrying the ink ribbon, is set onto the receiving and alignment elements.

During the following swivelling back of the support frame 10, additionally the axle ends of the winding bobbins 43 and 44 can then engage for an axially parallel alignment relative to the pressure roller 12 into corresponding support positions (for example support positions 47) of the support frame 10.

In the following, reference is made to FIG. 2 for illustrating the drive for the pressure roller 12 and the sheet draw-in roller 18. As illustrated in FIG. 2, the pressure roller 12 is driven by the motor 13 via a belt drive 48 with circulating belts 49, where the belt 49 is guided via a plurality of deflection rollers 50 and a capstan shaft 51. The capstan shaft 51, driven in this manner, is engaged with a gear wheel 53, disposed immediately next to the support position for the winding bobbin 44, via a gear wheel drive 52, which gear wheel 53 serves for the drive of the winding bobbin 44, inserted at this support position. Furthermore, a pulley 54, resting on the rotation axis 17 of the lever part 16, is driven via the gear wheel drive 52. The pulley 54 in turn drives the sheet draw-in roller 18 via a further belt 55.

The mode of operation of the invention image printing device is illustrated in the following with reference to FIGS. 3 and 4.

Figure 3:
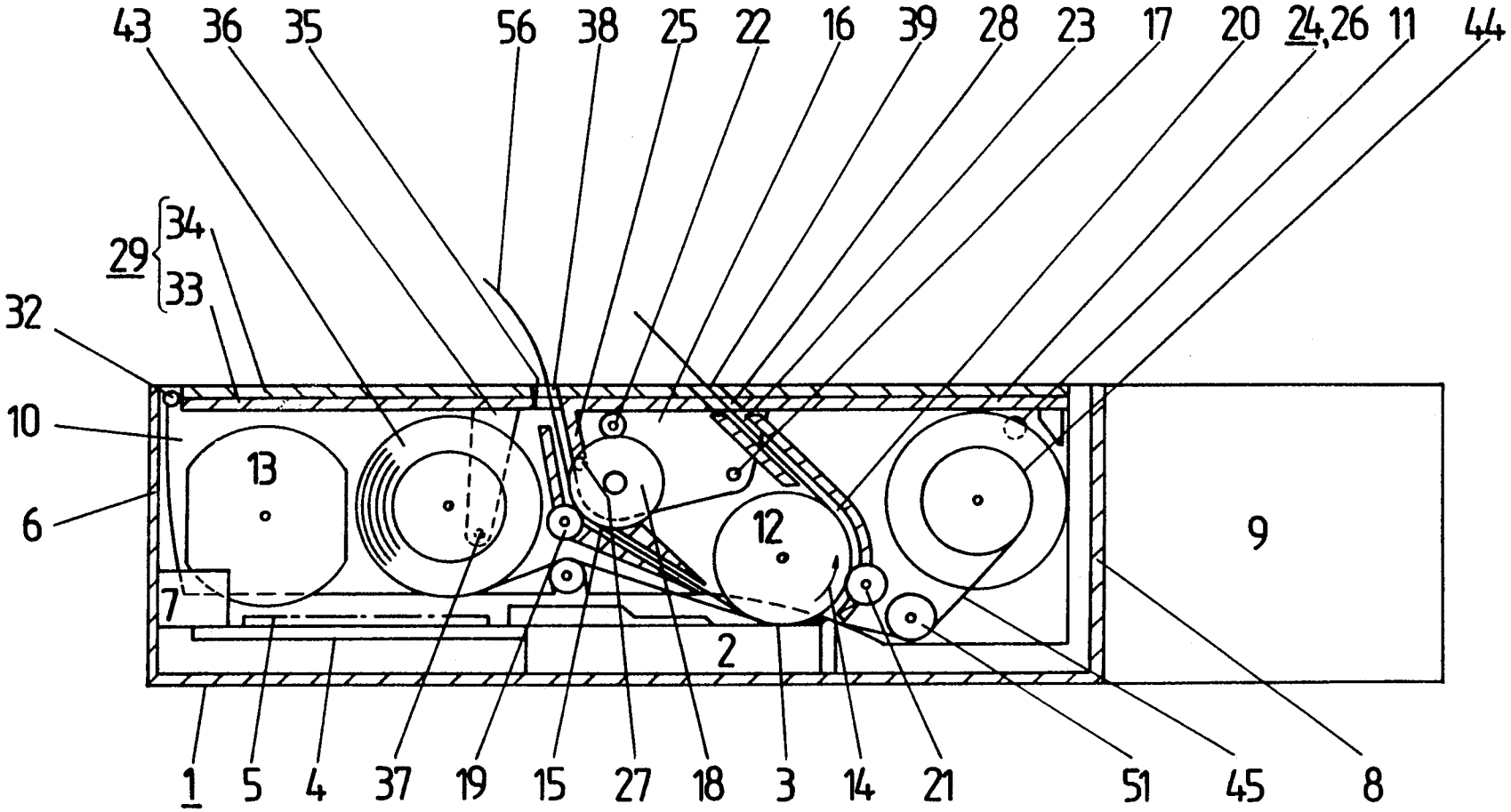
FIG. 3 a longitudinal sectional view through the embodiment of FIG. 1 in an operational mode for manual individual sheet feed.
Figure 4:
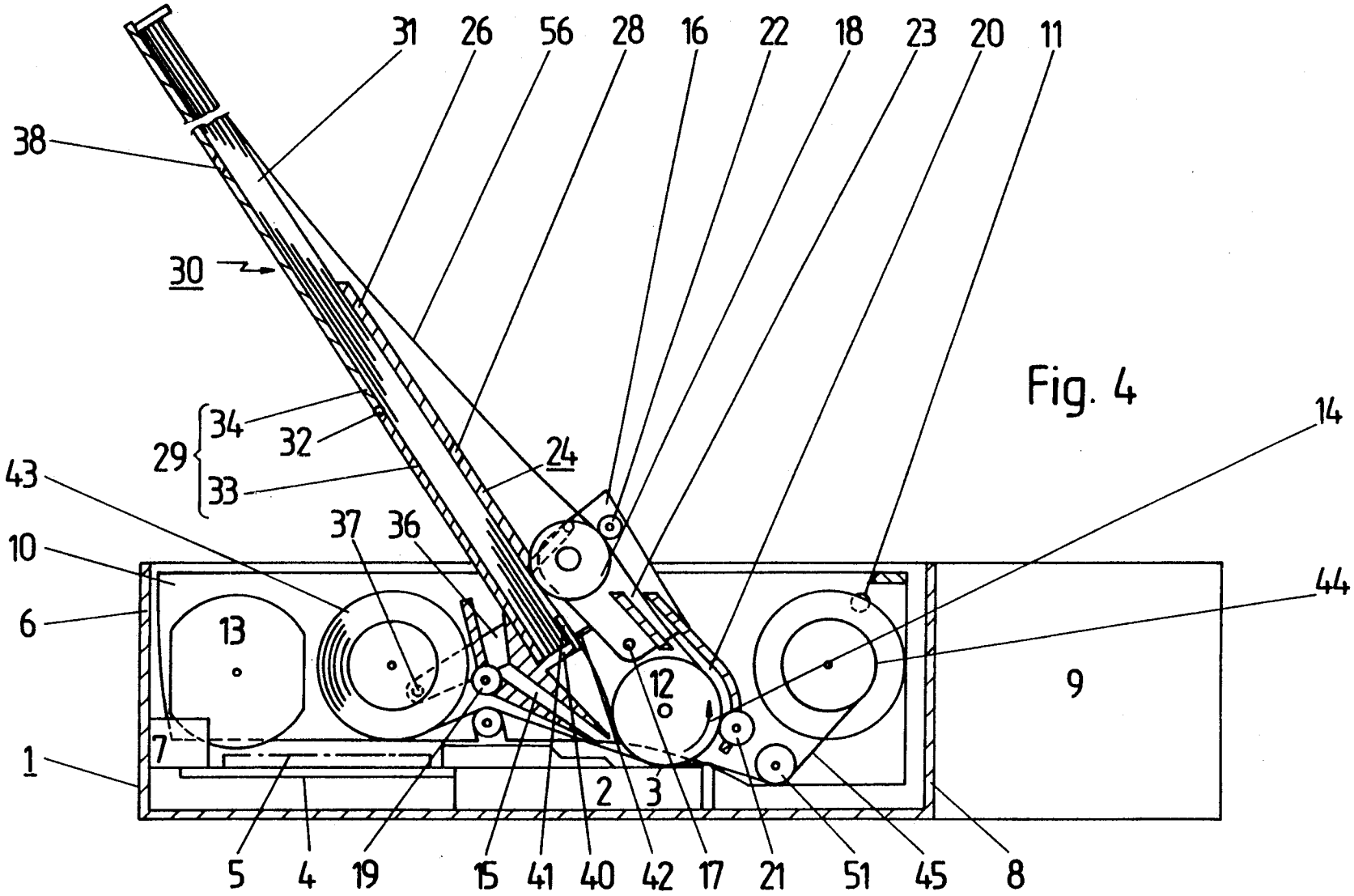
FIG. 4 a longitudinal sectional view through the embodiment of FIG. 1 in an operational mode for an automatic sheet separation and individual sheet feed.

FIG. 3 show the image printing device in the transport state or, respectively, in an operating state allowing the manual feeding of a recording substrate, designated here with reference numeral 56. The recording substrate 56 can be provided by an individual sheet or by endless paper. The two winding bobbins 43 and 44 with the ink ribbon 45, stored on the winding bobbins 43 and 44, are already inserted into the casing 1 in that the support frame 10 is initially flapped out of the casing 1, according to the illustration in FIG. 2, that the winding bobbin 44 is then inserted at the support position, provided for the winding bobbin 44, that the winding bobbin 43 is subsequently inserted in the support position 47, provided for the winding bobbin 43 by a swivelling of the support body 46, and finally that the support frame 10 is again flapped back into the casing 1. The sheet draw-in roller 18 rests at the counter roller 19 as illustrated in FIG. 3. The sheet deposit bin 24 is flapped into the casing 1 and is disposed below the closed cover 29. The casing 1 thus forms together with the plugged-in power supply part 9 a compact cuboid-shaped and thus easily transportable apparatus, closed on all sides with the exception of the sheet feed aperture 38 and the sheet ejection aperture 39.

The recording substrate 56 is inserted with its initial sheet edge through the sheet feed aperture 38 up to the draw-in slot, formed by the sheet draw-in roller 18 and the counter roller 19 resting at the sheet draw-in roller 18, into the apparatus for the printing. The recording substrate 56 is led through the sheet feed channel 15 up to the pressure roller 12 by a driving of the sheet draw-in roller 18. The pressure roller 12 is driven in sheet transport advance direction 14 and guides the recording substrate 56 past the heating elements 3 of the recording head 2 under intermediate positioning of the thermally sensitive ink ribbon 45. The recording substrate 56 is printed dependent on the control of the heating element 3 and is subsequently transported through the sheet ejection channel 20, the slot 28 into the sheet deposit bin 24 and through the sheet ejection aperture out of the image printing device. The used ink ribbon 45 is wound onto the winding bobbin 44 via the gear wheel 53 (compare FIG. 2).

In addition to the precedingly described mode of operation, the following further kinds of operation are possible with the modes of operation of the image printing device illustrated in FIG. 3. Thus, the recording substrate 56 can comprise a heat-sensitive recording material such that the winding bobbins 43 and 44 with the ink ribbon 45 are not required. In this case, the heat-sensitive recording substrate can be employed on a storage roller instead of the winding bobbin 43 in the casing 1. Furthermore, it is possible to wind the heat-sensitive recording substrate 56 onto the support position, provided for the winding bobbin 44, instead of the ink ribbon 45 in order to prevent that the print information becomes visible for everybody. In this case, the cover 29 can preferably be closed by a lock. The precedingly described modes of operation serve also in case of the use of a carbon-copy two-layer thermal paper, where the first layer is made of a thermally-sensitive paper and where said paper is in addition coated on the back side with a thermally-meltable color ink layer coating, and where the second layer comprises standard paper. This thermal paper can either be completely guided out of the device through the sheet ejection aperture 39 or can be separated after printing, wherein the heat-sensitive layer is wound up in the position of the winding bobbin 44 in the interior of the casing 1 and wherein the second layer, comprising standard paper, is guided out of the casing 1 through the sheet ejection aperture 39.

FIG. 4 illustrates the image printing device in a mode of operation allowing the automatic feed of individual sheet of a sheet stack 31. For this purpose, the winding bobbins 43 and 44 with the ink ribbon 45 are initially inserted into the support frame 10 in the same way as described above for FIG. 3 by way of the illustration provided in FIG. 2. In the following, the support frame 10 is flapped back into the interior of the casing 1. The cover 29 is then flapped apart under formation of the sheet storage cassette 30 in that initially the two cover parts 33 and 34 are flapped open to a planar sheet support face by lifting of the cover part 34 at its right end and in that the two cover parts 33 and 34 are subsequently jointly brought into and locked in the inclined position illustrated in FIG. 4. Furthermore, the lever part 16 is lifted either by hand or automatically in connection with the flipping open of the cover 29 via a linkage guide such that the cover part 33 comes to rest with its cover edge 35, disposed toward the sheet draw-in roller 18, opposite to the sheet stop edge 40 and passes through under the sheet draw-in roller 18. Upon lifting of the lever part 16, the sheet separating corners 41 are simultaneously lifted via the follower device 42, such that the stack 31 with the individual sheets can be inserted without effort into the sheet storage cassette 30. Finally, the sheet deposit bin 24 is swivelled toward the stack 31, where the sheet draw-in roller 18 rests on the uppermost individual sheet of the stack 31. The respective uppermost individual sheet forming the recording substrate 56 is withdrawn through the sheet separating corners 41 from the stack 31 by driving the sheet draw-in roller 18 and the respective uppermost individual sheet is led to the pressure roller 12, rotating in sheet transport advance direction 14. From the pressure roller 12, the recording substrate 56 is guided, under immediate positioning of the ink ribbon 45, past the heating elements 3 of the recording head 2 and the recording substrate 56 is printed on by the heating elements 3 of the recording head 2. In the following, the printed recording substrate 56 is guided by way of the pressure roller 12 through the sheet ejection channel 20 into the draw-in slot between the sheet draw-in roller 18 and the sheet transport advance roller 22 and the printed recording substrate 56 is further transported by these two rollers 18 and 22 into the sheet deposit bin 24. In a case where the individual sheets have to be replenished on the stack 31, it is sufficient to lift up the lever part to some extent such that the sheet separating corners 41 can also be lifted above the follower device 42 and allow the replenishing of the individual sheets.

Figure 5:
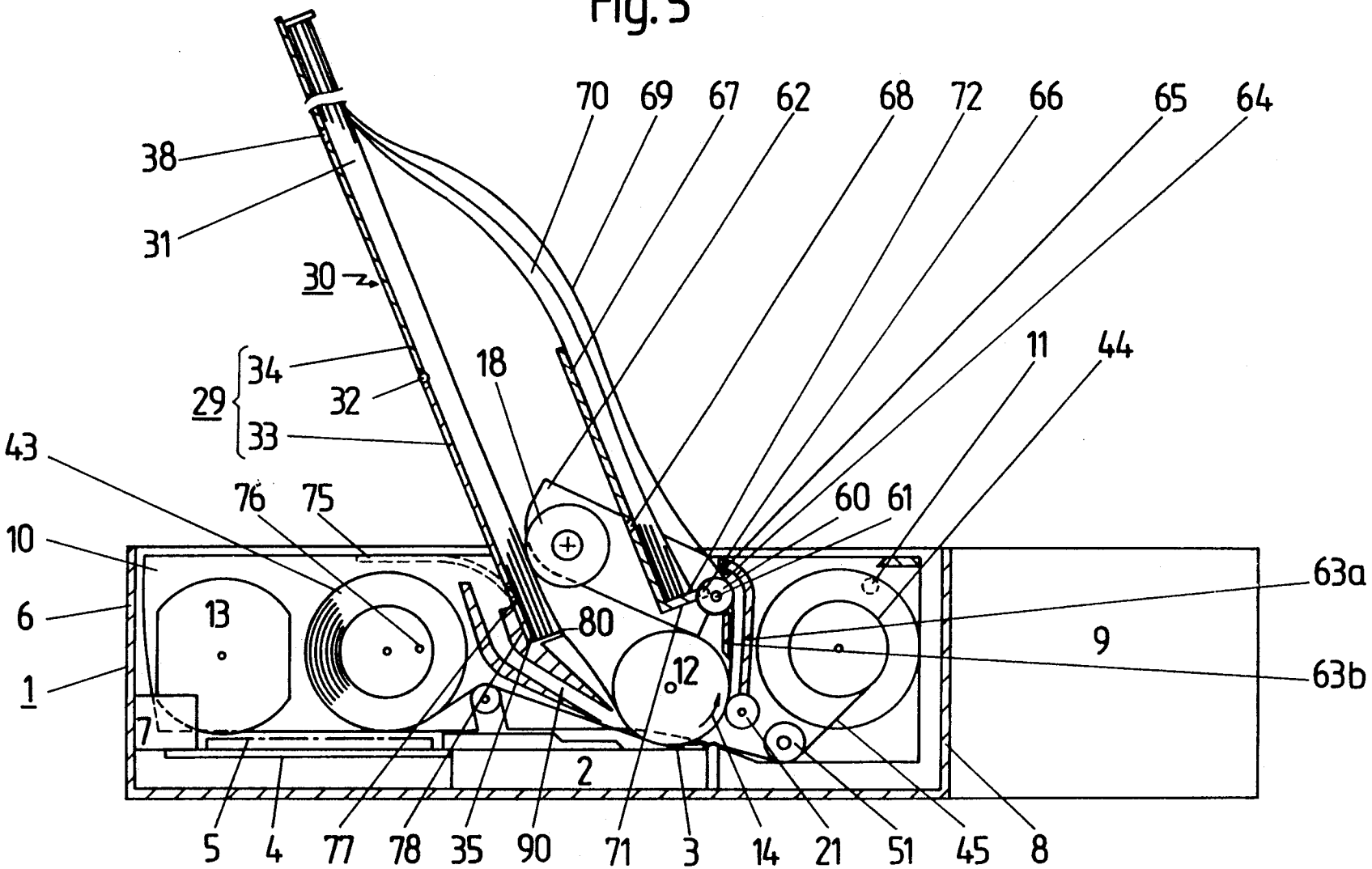
FIG. 5 a longitudinal sectional view through a second embodiment of the invention image printing device in an operational mode for an automatic sheet separation and individual sheet feed.

FIG. 5 shows in comparison to the image printing device, illustrated in FIGS. 1 through 4, a slightly modified embodiment of the invention image printing device. Coinciding elements of FIGS. 1 through 4 and 5 are designated with the same reference numerals. FIG. 5 illustrates the image printing device in a mode of operation allowing the automatic feed of individual sheets of the sheet stack 31. In distinction to the embodiment illustrated in FIGS. 1 through 4, a drivable sheet transport advance roller 60 is disposed behind the pressure roller 12 as seen in rotation direction 14 and concentrically to a rotation axis 61 of a support part 62, running in the upper region of the casing parallel to the pressure roller 12 instead of the sheet transport advance roller 22 in the embodiment according to FIG. 5. A sheet ejection channel, formed by two sheet ejection faces **63*a* and 63*b* follows to the sheet press-on roller 21 as seen in rotation direction 14. A spring element 65 is disposed at the ejection region 64 of the sheet ejection face 63*a* and is in springing contact with the sheet transport advance roller 60. A sheet deposit bin 67, tiltable around an axis 66, covered in FIG. 5 by the sheet transport advance roller 60 and disposed parallel relative to the rotation axis 61, is attached at the support part 62. The sheet deposit bin 67 exhibits a slot 68 which, in the closed state of the image printing device, allows an exit of a recording substrate guided along the ejection face 63 in the manner illustrated in connection with FIG. 3. A paper sheet 69, precedingly removed from the stack 31 of individual sheets, is led out of the casing 1 after passing at the heating elements 3 through the pressure roller 12 in connection with the sheet press-on roller 21 and the sheet transport advance roller 60 in connection with the spring element 65 and the paper sheet 69 touches with its upper region already a stack 70 of already printed paper sheets. The rear edge of the paper sheet 69, still in contact with the sheet draw-in roller 18, according to FIG. 5, is finally led out by the sheet transport advance roller 60 after rotation of the press roller 12 and is deposited completely on the stack 70 under resting at a sheet support face 71 of the sheet deposit bin 67. The sheet transport advance roller 60 submerges for this purpose in part into recesses 72 of the sheet deposit bin 67 or, respectively, of the sheet support face 71. In order to further stabilize the stack 70, it is possible to dispose a press-down holder rotatably around the axis 66, where the face of the press-down holder runs nearly parallel to the sheet deposit bin 67**.

According to a further distinction from the embodiment illustrated in FIGS. 1 through 4, the embodiment according to FIG. 5 exhibits guides fixed relative to the casing 1 and running parallel to the side walls connecting the casing walls 6 and 8 instead of the distance spacer parts 36. A guide 75 covered by the support frame 10 is indicated by dashed lines as an indication in FIG. 5. The guide 75 exhibits an approximately partial circular shape with a partial circular center point 76. The partial circular center point 76 of the guide 75 lies together with the partial circular center point of the guide, disposed on the oppositely disposed side wall and not illustrated, on a joint straight line, running below the casing upper side and parallel to the axes of the pressure rollers. The guides (for example 75) are formed as grooves in the respective side wall of the casing 1, which grooves are generated during the production process of the casing made of plastic material. The cover part 33 exhibits at its region close to the pressure roller side extensions, cooperating with the groove like guides, where only one extension 77 is visible in FIG. 5. The extension is covered and cooperates with the guide 75 of the cover part 33. The region of the cover part 33, close to the pressure roller, is supported by a rectangular, casing fixed support face 78 in the upright and inclined, unfolded position of the cover 29, forming the sheet storage cassette 30.

Since the guides (for example 75) and the extensions (for example 77) are formed directly in the casing 1 or, respectively, at the cover part 33, there can be dispensed with additional construction elements for effecting the swivellable cover support bearing.

According to a further distinction from the embodiment illustrated in FIGS. 1 through 4, the embodiment illustrated in FIG. 5 includes sheet separating corners 80, which are disposed immediately in the region of the hinge-remote edge 35 at the sides of the cover part 33. A sheet metal part, pressing against the lower side of the stack 31 based on a spring force, is disposed below the sheet stack 31 in the hinge-remote region of the cover part 33. The sheet separating corners 80 are furnished with a bolting, where the release of the bolting allows to sink the sheet separating corners 80 into the interior of the casing in the closed state of the image printing device.

The sheet draw-in roller 18 is disposed freely rotating in the interior of the casing 1 in the closed operation mode of the image printing device (cf. also FIG. 3). A paper sheet to be printed would in this case be inserted through the sheet feed aperture 38 in case of a closed cover 29 through a sheet feed channel 90 up into the contact region with the pressure roller 12.

It will be understood that each of the elements described above, or two or more together, may also find a useful application in other types of printing devices and printing procedures differing from the types described above.

While the invention has been illustrated and described as embodied in the context of an image printing device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims:

1. An image printing device comprising a casing having an upper side;

a pressure roller disposed in the casing;

a recording head disposed in the casing opposite to the pressure roller;

a sheet feed aperture contained in the upper side of the casing;

a sheet feed channel leading from the sheet feed aperture to the pressure roller;

a sheet ejection aperture contained in the upper side of the casing;

a sheet ejection channel leading from the pressure roller to the sheet ejection aperture;

a cover disposed on the upper side of the casing, wherein the cover is flappable for opening the cover;

means for fixing the cover in an inclined position in a flapped-open state under formation of the sheet storage cassette for a stack of individual sheets to be printed;

a drivable sheet draw-in roller disposed in the casing and tiltably supported at a lever part such that a sheet draw-in roller is disposed below the cover while the cover is closed, and wherein the sheet draw-in roller rests on the individual sheets, contained in the sheet storage cassette in case of an open cover.

2. The image printing device according to claim 1, further comprising a counter roller to the sheet draw-in roller, wherein the sheet draw-in roller rests in a course of the sheet feed channel at the counter roller while the cover is closed.

3. The image printing device according to claim 1, further comprising a spacer part;

a rotation axis running below the upper side of the casing, wherein the cover is furnished with a cover edge disposed facing the sheet draw-in roller and parallel to the sheet draw-in roller, and wherein the cover is tiltably supported in a region of the cover edge by the spacer part around the rotation axis.

4. The image printing device according to claim 3, further comprising sheet separating corners disposed in the region of ends of the cover edge for separating individual sheets stored in the sheet storage cassette, wherein the cover includes at least one sheet stop in the region of the cover edge disposed facing the sheet draw-in roller and disposed parallel to the sheet draw-in roller.

5. The image printing device according to claim 4, wherein the cover is formed of a first cover part and of a second cover part, wherein the first cover part is connected at a parallel edge, disposed opposite the cover edge disposed facing the sheet draw-in roller, by a hinge to the second cover part.

6. The image printing device according to claim 1, further comprising casing-fixed guides of a parallel circular shape, wherein center points of partial circles are disposed on a straight line running parallel to the pressure roller and running below the upper side of the casing;

extensions attached to the cover in a region of an end of the cover disposed near the sheet draw-in roller, which extensions are led in the casing-fixed guides.

7. The image printing device according to claim 1, further comprising a sheet stop edge with sheet separating corners disposed in the casing and serving as a stop for the individual sheets, stored in the sheet storage cassette, where the cover is disposed with a cover edge opposite to the sheet stop edge in a flapped-open state of the cover.

8. The image printing device according to claim 7, further comprising a follower device disposed at the lever part and supporting the sheet draw-in roller;

spring support means for holding springingly the sheet separating corners at the sheet stop edge, wherein the sheet separating corners are liftable by the follower device together with the sheet draw-in roller from the stack of individual sheets in the sheet storage cassette.

9. The image printing device according to claim 1, further comprising a pivotally mounted sheet deposit bin for receiving of printed individual sheets, coming from the sheet ejection channel, supported at the lever part carrying the sheet draw-in roller, where the sheet deposit bin is disposed flappable from a sunken position below said cover in the casing of the device while the cover is closed, into an approximately parallel inclined position while the cover is flapped open.

10. The image printing device according to claim 9, further comprising a sheet transport advance roller, wherein the sheet draw-in roller, upon resting on the individual sheets contained in the sheet storage cassette, rests together with the sheet transport advance roller, resting at the sheet draw-in roller, in a course of the sheet ejection channel, and wherein the sheet deposit bin is disposed immediately behind the sheet draw-in roller as seen in sheet transport advance direction of the sheet draw-in roller.

11. The image printing device according to claim 9, further comprising a drivable sheet transport advance roller disposed concentrically to a rotation axis of the lever part and resting between the pressure roller and the sheet draw-in roller while the sheet draw-in roller is resting on the individual sheets contained in the sheet storage cassette, and wherein the sheet deposit bin is disposed immediately behind the sheet transport advance roller as seen in sheet transport advance direction.

12. The image printing device according to claim 1, further comprising a support frame pivotally held in the casing and protruding upwardly out of the casing; and a recording head with an electrical control device and disposed in a floor region of the casing, wherein at least the pressure roller and the lever part are held with the sheet draw-in roller at the support frame.

13. The image printing device according to claim 12, further comprising a belt drive;

a gear wheel, wherein the support frame assumes a first support position in front of the pressure roller and a second support position behind the pressure roller as seen in sheet transport advance direction of the pressure roller for insertion of a first winding bobbin disposed axially parallel to the pressure roller, and wherein the gear wheel engages the belt drive and is disposed at the support frame immediately next to the second support position behind the pressure roller for driving a second winding bobbin, inserted at a first support position and said second support position.

14. The image printing device according to claim 1, further comprising receiving and alignment elements disposed in a floor region of the casing for a detachable attachment of a support body for a pressure-roller-parallel receiving of winding bobbins disposed parallel to the pressure roller.

15. The image printing device according to claim 1, wherein a pivotally mounted sheet deposit bin (24) for receiving of printed individual sheets, coming from the sheet ejection channel (20), is supported at the lever part (16) carrying the sheet draw-in roller (18), where the sheet deposit bin (24) can be flipped from a sunken position in case of a closed cover (29) below said cover in the casing (1) of the device, into an approximately parallel inclined position in case of a flapped-open cover (29).

16. The image printing device according to claim 15, wherein the sheet draw-in roller (18), upon resting on the individual sheets (31), contained in the sheet storage cassette (30), rests together with a sheet transport advance roller (22), resting at the sheet draw-in roller (18), in a course of the sheet ejection channel (20), wherein the sheet deposit bin (24) is disposed immediately behind the sheet draw-in roller (18) as seen in sheet transport advance direction of the sheet draw-in roller (18).

17. The image printing device according to claim 15, wherein a drivable sheet transport advance roller (60), disposed pressure roller (12), and a second support position behind the pressure roller (12), as seen in sheet transport advance direction (14) of the pressure roller (12), for insertion a first winding bobbin (43), disposed axially parallel to the pressure roller (12), and wherein a gear wheel (53) engages a belt drive (48) and is disposed at the support frame (10) immediately next to the second support position behind the pressure roller (12) for driving the second winding bobbin (44), employed at said first support position, and said second support position.

18. An image printing device with a recording head (2), which is disposed in a casing (1) of the device opposite to a pressure roller (12), with a sheet feed aperture (38) contained in an upper side of the casing, where a sheet feed channel (15) leads from the sheet feed aperture (38) to the pressure roller (12);

and with a sheet ejection channel (20), which leads from the pressure roller (12) to a sheet ejection aperture (39), contained in the upper side of the casing, wherein the upper side of the casing exhibits a cover (29) which can be flapped open, which can be fixed in an inclined position in a flapped-open state under formation of a sheet storage cassette (30) for a stack (31) of individual sheets to be printed, and wherein a drivable sheet draw-in roller (18) in the casing (1)

is tiltably supported at a lever part (16) such that the sheet draw-in roller (18) is disposed below the cover (29) in case of a closed cover (29) and rests on the individual sheets, contained in the sheet storage cassette (30) in case of an open cover (29).

19. The image printing device according to claim 18, wherein the sheet draw-in roller (18) rests in case of a closed cover (29) in a course of the sheet feed channel (15) at a counter roller (19).

20. The image printing device according to claim 18, wherein the cover (29) is tiltably supported in a region of a cover edge (35), disposed toward the sheet draw-in roller (18) and parallel to the sheet draw-in roller (18), by a spacer part (36) around a rotation axis (37), running below the upper side of the casing.

21. The image printing device according to claim 18, wherein the cover (29) exhibits extensions (for example 77) in a region of the end near the sheet draw-in roller (18), which extensions are led in casing-fixed guides (for example 75), and wherein the guides (for example 75) are of a partial circular shape, wherein center points of partial circles are disposed on a straight line running parallel to pressure rollers and running below the upper side of the casing.

22. The image printing device according to claim 18, wherein a sheet stop edge (40) with sheet separating corners (41) and serving as a stop for the individual sheets (31), stored in the sheet storage cassette (30), is disposed in the casing (1), where the cover (29) in a flapped-open state comes to be disposed with a cover edge (35) opposite to the sheet stop edge (40).

23. The image printing device according to claim 22, wherein the sheet separating corners (41) are springingly held at the sheet stop edge (40) and can be lifted by a follower device (42) at the lever part (16), supporting the sheet draw-in roller (18), together with the sheet draw-in roller (18) from the stack (31) of individual sheets in the sheet storage cassette (30).

24. The image printing device according to claim 18, wherein the cover (29) exhibits at least one sheet stop in a region of a cover edge (35), disposed facing the sheet draw-in roller (18) and parallel to the sheet draw-in roller (18), and with sheet separating corners for the individual sheets stored in the sheet storage cassette (30) in the region of ends of a cover edge (38).

25. The image printing device according to claim 24, wherein the cover (29) is formed of two cover parts (33, 34), where one cover part (33) is connected at a parallel edge, disposed opposite the cover edge (35) facing the sheet draw-in roller (18), by a hinge (32) to the other cover part (34).

26. The image printing device according to claim 18, wherein the recording head (2) with an electrical control device (5) is disposed in a floor region of the casing (1) of the device, and wherein at least the pressure roller (12) and the lever part (16) are held with the sheet draw-in roller (18) at a support frame (10), wherein the support frame (10) is pivotally held in the casing (1) and protrudes upwardly out of the casing (1).

27. The image printing device according to claim 26, wherein the support frame (10) exhibits a first support position in front of the pressure roller (12), and a second support position behind the pressure roller (12), as seen in sheet transport advance direction (14) of the pressure roller (12), for insertion a first winding bobbin (43), disposed axially parallel to the pressure roller (12), and wherein a gear wheel (53) engages a belt drive (48) and is disposed at the support frame (10) immediately next to the second support position behind the pressure roller (12) for driving the second winding bobbin (44), employed at said first support position, and said second support position.

28. The image printing device according to claim 18, wherein receiving and alignment elements are provided in a floor region of the casing for a detachable attachment of a support body (46) for a pressure-roller-parallel receiving of winding bobbins (43, 44).

* * * * *

UNITED STATES PATENT AND TRADEMARK OFFICE

CERTIFICATE OF CORRECTION

PATENT NO. : 5,268,705

DATED : December 7, 1993

INVENTOR(S) : Karl-Heinz Dreinhoff et al

It is certified that error appears in the above-indentified patent and that said Letters Patent is hereby corrected as shown below:

Title page under [63] Related U.S. Application Data: delete "Continuation-in-part of PCT/DE90/00312, Apr. 4, 1990." and substitute therefor --Continuation-in-part of PCT/DE90/00312, Apr. 26, 1990--.
Title page under [30] Foreign Application Priority Data: delete "Apr. 28, 1989 [DE] Fed. Rep. of Germany.....730113" and substitute therefor --Apr. 28, 1989 [EP] Europe.....89730113--.

Signed and Sealed this

Second Day of August, 1994

*Attest:*

*Attesting Officer*

BRUCE LEHMAN

*Commissioner of Patents and Trademarks*